US007395624B2

(12) United States Patent
Murrell

(10) Patent No.: US 7,395,624 B2
(45) Date of Patent: Jul. 8, 2008

(54) DIORAMA BALL WITH IMITATION FOG

(76) Inventor: Jon F. Murrell, 1836 Beverly Blvd., Berkley, MI (US) 48072

( * ) Notice: Subject to any disclaimer, the term of this patent is extended or adjusted under 35 U.S.C. 154(b) by 359 days.

(21) Appl. No.: 11/385,114

(22) Filed: Mar. 21, 2006

(65) Prior Publication Data

US 2006/0213096 A1 Sep. 28, 2006

(51) Int. Cl.
*G09F 19/00* (2006.01)

(52) U.S. Cl. ..... 40/409

(58) Field of Classification Search ..... 40/409, 40/410

See application file for complete search history.

(56) References Cited

U.S. PATENT DOCUMENTS

| | | | | | |
|---|---|---|---|---|---|
| 2,361,423 | A * | 10/1944 | Snyder | ..... | 40/410 |
| 4,817,311 | A * | 4/1989 | Ong S. T. | ..... | 40/410 |
| 5,131,175 | A * | 7/1992 | Liu | ..... | 40/410 |
| 5,258,209 | A * | 11/1993 | Bankert et al. | ..... | 428/11 |
| 6,193,106 | B1 * | 2/2001 | Ho et al. | ..... | 222/78 |
| 6,449,887 | B1 * | 9/2002 | Song | ..... | 40/406 |

* cited by examiner

*Primary Examiner*—Gary C Hoge

(57) ABSTRACT

Diorama balls contain a liquid and fine particles not individually visible to the unaided eye. The fine particles exert a "fog-like" effect particularly suitable for marine and aero dioramas.

4 Claims, 2 Drawing Sheets

DIORAMA BALL WITH IMITATION FOG

BACKGROUND OF THE INVENTION

1. Field of the Invention

The present invention pertains to a diorama ball with a fog effect.

2. Background Art

Diorama balls as used herein are hollow glass containers, generally spherical, with a diorama inside, and filled with a liquid. Diorama balls with a snow effect are common at holiday times, and may contain, for example, a snowman, Santa Claus, a Currier and Ives-type scene, etc. The balls also contain water, and white flakes. When the ball is turned upside down or shaken, the white flakes distribute throughout the liquid and fall, resembling snow.

SUMMARY OF THE INVENTION

The present invention is directed to diorama balls which have a permanent or temporary fog-like effect.

DETAILED DESCRIPTION OF THE PREFERRED EMBODIMENT(S)

Figure 1A:
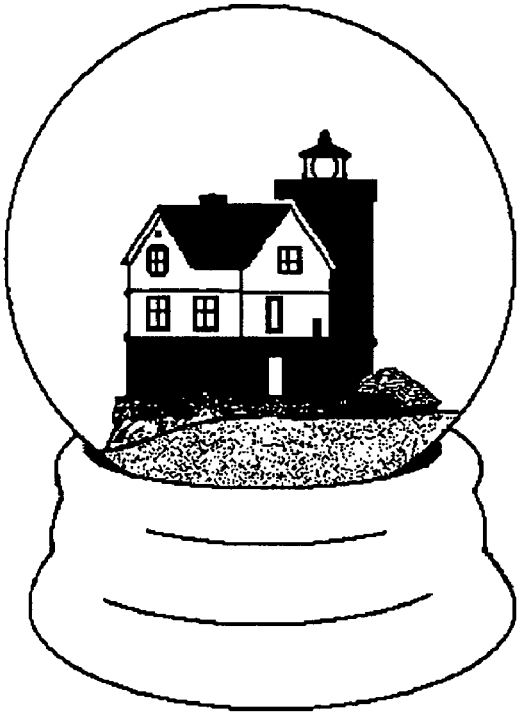
FIGS. 1*a* and 1*b* depict one embodiment of the subject invention diorama balls.

The diorama balls of the present invention contain a diorama. The diorama may be a building or buildings, a light house, a plane or boat, a human or animal figure, etc. This list is illustrative, and not limiting. In preferred embodiments, the diorama will comprise a lighthouse with a working light, together with rocks, earth, or sand characteristic of the location of a real lighthouse of which the diorama lighthouse is a small scale replica. For example, the lighthouse may be a replica of the Round Island Light near Mackinac Island, Mich., and the bottom of the diorama ball may contain sand from Round Island or another location from the Great Lakes. The light of the lighthouse may consist of one or a plurality of LEDs, and may emit continuously, discontinuously, or when a plurality of LEDs are used, in sequence, etc. The LEDs are powered by an external source of electricity, preferably by one or more batteries in the base on which the diorama ball is mounted. An electrical switch may be used to switch the LED circuitry on or off, and a timing circuit, e.g. a function generator, may be used to produce a blinking signal if desired.

In a further preferred embodiment, the diorama consists of an airplane suspended by means of a thin stalk-like support. The airplane may have LEDs mounted therein, for example on the wingtips, in a similar manner to the LEDs described above with respect to the lighthouse. The LEDs may be red and green, for example.

In yet a further embodiment, the diorama may be a ship or boat, which may "float" on a "sea" of colored plastics material, for example a water-blue or blue-green acrylic plastic. The surface may be smooth or may be molded to simulate waves. The boat will have LED running lights in this preferred embodiment.

The remainder of the interior of the ball not occupied by the diorama or other components will contain a clear fluid, preferably water, which may also be dyed if desired to produce a transparent but colored liquid. In the clear fluid, very fine particles are contained, the size of these particles being such that individual particles cannot be seen by the unaided eye, but of sufficient size so as to produce a cloudy or fog-like effect. These particles may be termed "fog-producing particles" herein.

The cloudy or fog-like effect may be obtained by permanently suspending fine particles in the clear liquid. For example, fine particles of hydrophilic silica may be suspended, optionally with the aid of a dispersing agent, i.e. a surfactant, or by means of yet finer particles of silica in the colloidal size range. An advantage of the use of fine particle silica is that silica is essentially insoluble in water, so changes in the cloudy effect over time are minimal. Hydrophilic silicas are available from suppliers such as Degussa, Cabot, and Wacker-Chemie. The particles need not be inorganic in nature. Very fine particulate thermoplastics with a specific gravity greater than 1 may be used as well.

As is well known in chemistry, if the particle size is too small, i.e. of colloidal dimensions, a cloudy effect cannot be obtained. Rather, the solution will appear transparent or nearly so, although the existence of particles can generally be verified by observing, at an angle, a laser beam passing through the liquid. The laser beam will become visible due to multiple reflections from the invisible particles (Tyndal effect).

However, the particles must not be so large that individual particles are visible. First, such larger particles will, in general, sediment very quickly, so any visual effect will be of short duration. Also, the cloudy or fog-like effect will not be realistic if the particles can be observed visually. In general, the limit of visibility is about 100 μm, and the particles are preferably below 50 μm in size, on average, more preferably below 25 μm in size. The suitability of any particular suspended solid can be easily determined by dispersing the solid particles in the clear liquid and visually observing the effect. If numerous particles can be seen, the solid is of too large an average particle size or has too broad a particle size distribution. If no cloudy or fog-like effect is observable, the average particle size is too small.

The particles may also be created in situ by common precipitation reactions, for example by dissolving small amounts of calcium oxide (lime) in water to produce calcium hydroxide; by precipitation of silica by the well known techniques used to prepare precipitated silica industrially; or by reaction of lime water with an ammonium or alkali metal alum. A presently preferred method of creating the cloudy or fog-like effect is to react 700 mg alum dissolved in 1 liter of water with 700 mg parts lime. Another preferred method is to react 400 mg alum with 700 mg lime under the same conditions.

Most preferably, the cloudy or fog-like effect is temporary rather than permanent, and in most preferred versions, as the "fog" settles, a stratified effect is created, with a clear area above and a cloud or fog layer below. Such stratification is obtainable by adjustment of the amount and size of the particulates, adjusting the amount of any dispersant or surfactant, etc.

The clear liquid is preferably water, but other liquids such as simple glycols or mixtures of glycols or alcohols with water are also suitable. Any clear liquid can be used, but it is highly preferably that the liquid not be flammable or toxic. If a more viscous liquid is desired, for example to prolong the duration of the cloudy or fog-like effect, a viscosifier may be added. Preferred viscosifiers are very high molecular weight polyoxyethylene glycols, polyacrylic acids, and like substances. Most preferred are viscosifiers which can be used in very low amounts. Examples are associative thickeners such as triblock polyoxyalkylene ethers having an internal hydrophilic polyoxyethylene block and hydrophobic external blocks produced by oxyalkylating a polyoxyethylene glycol (internal hydrophile) with a long chain alkylene oxide such as a $C_{8-30}$ α-alkylene oxide. Such associative thickeners are well known, and are easily synthesized or available from BASF Corporation. The advantage of such thickeners is that very low amounts, i.e. 0.1 to 3 weight percent, are needed, and yet significant viscosity increases may be achieved. The very low amounts do not cause any flammability concerns, and the compounds themselves are not toxicologically suspect.

Figure 1B:
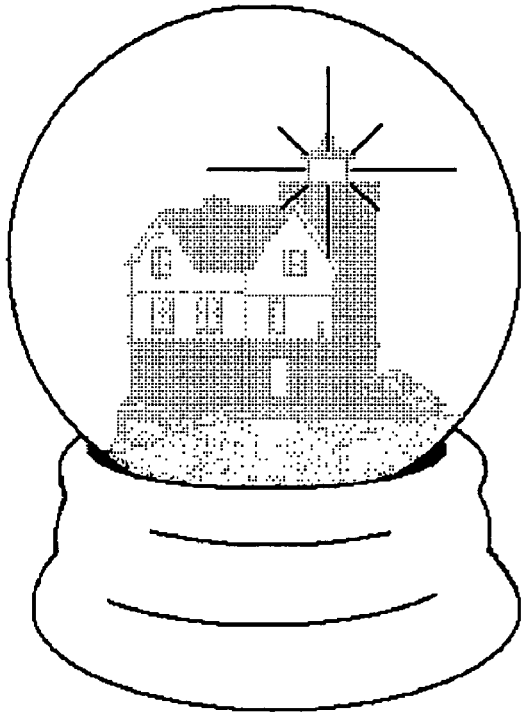

FIG. 1*a* illustrates one embodiment of the present invention, wherein the diorama ball contains a lighthouse, Lake Michigan sand, and fine particulates prepared by reacting a lime solution with an alum solution. Upon shaking or inverting, the lighthouse is partially obscured by fog, but its light, a blinking LED, can be observed piercing the fog, as shown in FIG. 1*b*. Over time, the fog settles, restoring the clarity of the clear liquid, and now observable (since it is in bulk) as a fine snow or frost on the ground. The particles cannot be individually observed by the unaided eye while suspended in the clear liquid.

Figure 2A:
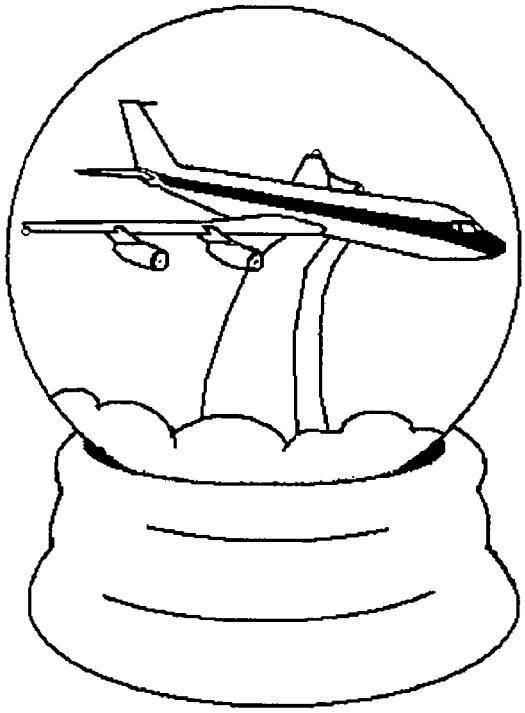
FIGS. 2*a* and 2*b* depict one embodiment of the subject invention diorama balls.
Figure 2B:
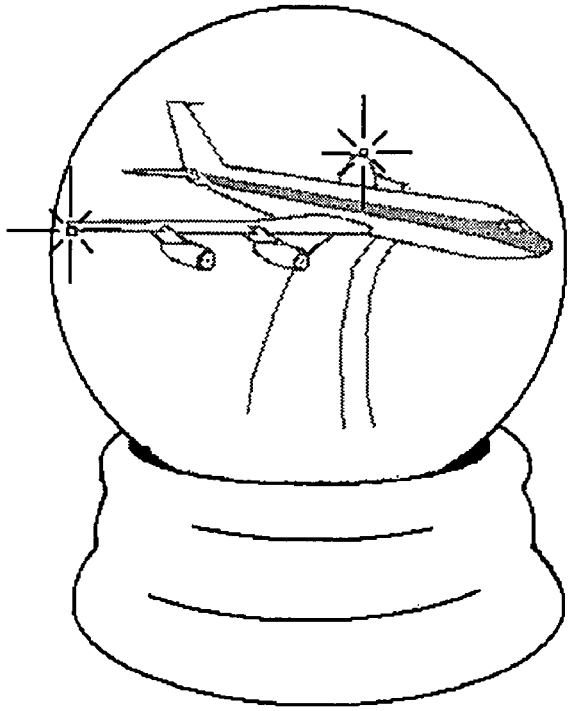

FIG. 2*a* illustrates another embodiment of a diorama ball, wherein the diorama comprises a jetliner suspended near the middle of the ball. In FIG. 2*b*, the plane appears to be flying through a cloud, with LEDs on its wingtips blinking.

The "clear liquid" is descriptive of the liquid phase only. In preferred embodiments, the particles which are dispersible within the clear liquid will gradually settle such that the liquid observable within the ball is clear. However, in other cases, the clear liquid will contain some very fine particles which will not settle out or which do so only after a very long period of time. In such cases, the liquid observable in the ball may not be clear, but rather translucent, the cloudy or fog-like effect intensifying upon inverting or shaking. In yet another embodiment, the particles will remain indefinitely suspended in the clear liquid, such that the liquid observable within the ball will appear permanently cloudy or fog-like.

Manufacture of the diorama balls is done by conventional methods which are used, for example, with "snow-effect" balls. However, if it is desired that an external power source for the LEDs be provided, then electrical wires must pass through the seal between the opening in the bottom of the ball and its support. In general, the diorama will be assembled substantially on the support, and the support adhesively bonded and sealed to the edges of the hole in the bottom of the ball. The base is preferably hollow so as to contain batteries, timing circuits, etc., and its exterior may be imprinted with a name for the diorama, signed by the creater, etc. In especially preferred embodiments, the base may also contain a mechanical or electromechanical music box movement.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A diorama ball having a diorama therein and filled with clear liquid, the diorama ball also containing fine particulates, particles of which are not visible to the unaided eye, but which form a cloud or fog when the diorama ball is inverted and/or shaken, or which form a perpetual cloud or fog.

2. The diorama ball of claim 1 wherein said clear liquid comprises water.

3. The diorama ball of claim 1, wherein said fine particulates are prepared by reacting lime and alum in aqueous solution.

4. The diorama ball of claim 1, wherein the fine particulates comprise silica.

* * * * *